US007320145B2

(12) United States Patent
Hochmuth

(10) Patent No.: US 7,320,145 B2
(45) Date of Patent: Jan. 22, 2008

(54) GLOVE REINFORCEMENT, IN PARTICULAR A GOALKEEPER GLOVE

(75) Inventor: Peter Hochmuth, Treuchtlingen (DE)

(73) Assignee: Helmut Hussenoder, Sindelfingen (DE)

( * ) Notice: Subject to any disclaimer, the term of this patent is extended or adjusted under 35 U.S.C. 154(b) by 0 days.

(21) Appl. No.: 11/474,131

(22) Filed: Jun. 23, 2006

(65) Prior Publication Data

US 2007/0028354 A1 Feb. 8, 2007

Related U.S. Application Data

(63) Continuation of application No. PCT/EP2004/012866, filed on Nov. 12, 2004.

(30) Foreign Application Priority Data

Dec. 23, 2003 (DE) ..... 103 61 434

(51) Int. Cl.
*A41D 19/00* (2006.01)

(52) U.S. Cl. ..... 2/161.1; 2/163

(58) Field of Classification Search ..... 2/16, 2/20, 21, 161.1, 161.6, 163, 161.2, 161.3; 128/879, 880
See application file for complete search history.

(56) References Cited

U.S. PATENT DOCUMENTS 1,951,190 A * 3/1934 Gambee ..... 2/21
4,507,804 A * 4/1985 Consigny ..... 2/21
6,058,503 A * 5/2000 Williams ..... 2/16
6,577,177 B2 * 6/2003 Zhou et al. ..... 327/317
6,725,466 B2 * 4/2004 Hochmuth ..... 2/161.1
6,813,781 B2 * 11/2004 Wilder et al. ..... 2/161.1
2006/0048259 A1 * 3/2006 Keppler et al. ..... 2/21

* cited by examiner

*Primary Examiner*—Katherine Moran
(74) *Attorney, Agent, or Firm*—Schwegman, Lundberg & Woessner P.A.

(57) ABSTRACT

The invention relates to a reinforcement (2) for a glove (17), in particular a goalkeeper glove comprising a) an arrangement (3) of several interconnected first elements (3*a* to 3*f*), b) several second elements (4*a*, 4*e*) connected or connectable to the arrangement of the first elements (3*a*, 3*f*) in such a way that at least two stopping surfaces (14, 15) are formed between at least two second elements (4*a*, 4*e*), in particular between all second elements (4*a*, 4*e*), wherein c) the arrangement (3) of the first elements (3*a*, 3*f*) can be bent from a substantially extended state to a curved state during a forward movement and unbent from the curved state to the extended state during a back movement, wherein d) in the curved state, d1) an interspace (11, 32) is formed between the adjacent first elements (3*a*, 3*f*) and d2) and an interspace (16) is formed between the stopping surfaces (14, 15) of the adjacent second elements (4*a*, 4*e*) in the extended state and e) said stopping surfaces (14, 15) of the adjacent second elements (4*a*, 4*e*) are at least partially connectable therebetween and counteract to the back movement.

20 Claims, 4 Drawing Sheets

GLOVE REINFORCEMENT, IN PARTICULAR A GOALKEEPER GLOVE

Figure 1:
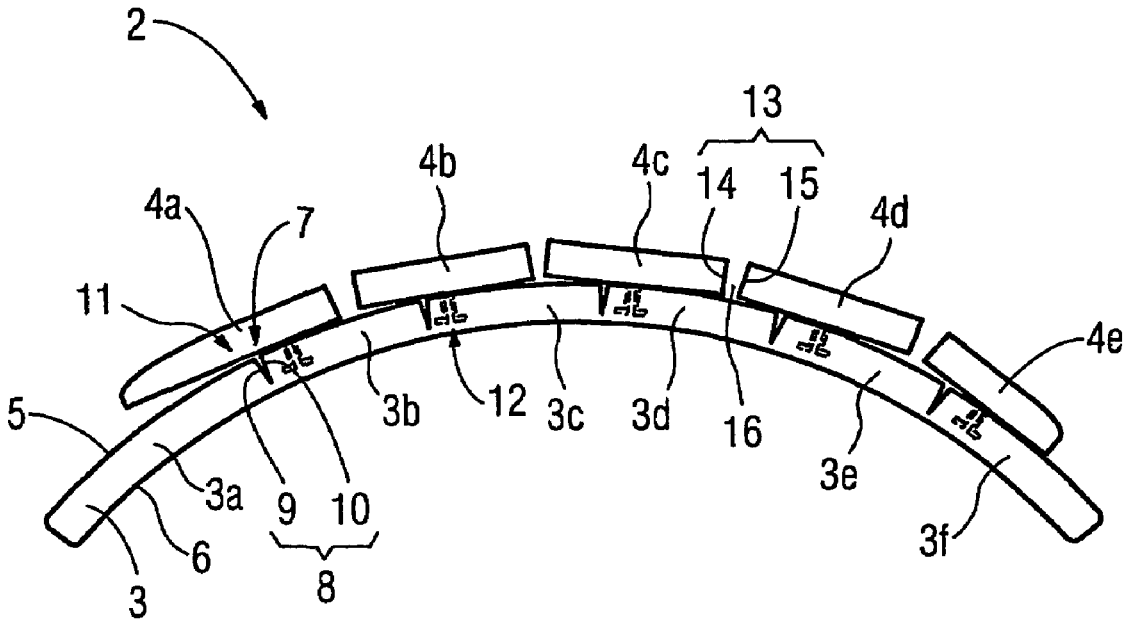

This application is a continuation under 35 U.S.C. 111(*a*) of PCT/EP2004/012866, filed Nov. 12, 2004. and published on Jul. 21, 2005 as WO 2005/065789A1, which claims the benefit under 35 U.S.C. 119 of German Application No. DE 103 61 434.6, filed Dec. 23, 2003, which applications and publication are incorporated herein by reference.

The invention relates to a glove reinforcement, in particular a goalkeeper glove.

A human hand includes numerous finger joints. A glove drawn over the hand covers these finger joints. The glove must therefore be configured so that it limits the motion of the joints as little as possible.

The finger joints of the hand generally allow only a forwards movement from an extended state of the fingers toward the palm of the hand. With an opposite backwards movement of the fingers, movement is limited by the finger joints such that, a backwards movement is naturally possible only up to the extended state of the fingers. If this limitation of the backwards movement is overcome by force, i.e. the fingers become hyper extended, and then a finger joint can be injured.

In many fields of application for gloves, the danger exists that an excessive force is exerted on a gloved hand such that the natural limits of backwards movement are reached within the hand itself as well as in the finger joints. Dangers of that type exist, for example, for a goalkeeper with ball sports but also for motorcyclists, laborers, and skiers. For example, with deflecting and catching of a ball with ball sports such as soccer, extreme forces upon the hand and fingers in unfavorable circumstances can lead to injury caused by this hyperextension of the fingers.

A glove must therefore be compatible for several tasks. For example, the goalkeeper glove should not impair, rather it should even improve the ability to catch as well as protect the fingers and wrists from forces that occur with ball contact.

Therefore, gloves particularly goalkeeper gloves, motorcycle gloves, ski gloves and work gloves which are provided on the side of the upper hand or at the outside with a stiffening structure which allows for the natural movement of the fingers, but which resists, however, the extreme natural limits of backwards movement.

An embodiment of a stiffening for gloves is known from DE 35 16 545 C2. The disclosed glove shows on a back side of a glove, at least in specific surface areas, a tension-proof but flexible inner material configuration, and an outer material configuration from elements which are lengthwise strung to each other and pressure resistant. The elements of the outer material configuration are limited under formation of interspaces on the inner material configuration such that they collide in a locking manner shortly before the stretching position of the glove.

Another stiffening for gloves which builds on the experiences with the aforementioned embodiment is known from DE 100 10 404 AI . The glove described therein contains support elements which shows a majority of prefabricated members which are jointly bound with each other particularly by a tension device, for example a band and that shows side surface and locking surfaces in the supporting elements. Disadvantageously accompanying these support elements are of complex construction and therewith require effortful production.

The task for the instant invention fundamentally is for a more simply constructed and cost effective glove reinforcement, particularly a goal keeper glove.

This task is solved according to the invention through a reinforcement according to the features of claim 1. Advantageous renderings, further developments and uses of the glove reinforcement are set forth in claims dependent upon claim 1.

Accordingly claim 1 relates to a glove reinforcement in particular a goalkeeper glove, a) an arrangement of several interconnected first elements, b) several second elements, connected or connectable to the arrangement of the first elements in such a way that at least two stopping surfaces are formed between at least two second elements, in particular between all second elements c) wherein the arrangement of the first elements can be bent from a substantially extended state to a curved state during a forward movement, and unbent from the curved state to the extended state during a back movement, wherein d) in the curved state, d1) an interspace is formed between the adjacent first elements, d2) an interspace is formed between the stopping surfaces of the adjacent second elements, and e) in the extended state said stopping surfaces of the adjacent second elements are at least partially connected therebetween and counteract the backward movement Forwards movement is a bending movement of the arrangement of first elements at which the curving of the arrangement of first elements generally increases. At use of the reinforcement in a finger movement of a glove, the forwards movement of the arrangement of first elements corresponds to the angular movement of the fingers, for example when forming a fist. The backwards movement is a bending movement of the arrangement of first elements in an opposite direction to the forwards movement, i.e., the curve of the arrangement of first elements generally decreases. In this case of finger movement of a glove, it corresponds to the backwards movement of the extension movement of the fingers.

The achieved advantage of the invention among others is that the reinforcement is simply configured and therefore cost-effective to manufacture. As to the functionality of the glove, the advantage during uses lies therein, that hyperextension of the fingers through excessive applied force is resisted at the second elements. The bendability of the reinforcement can alone be guaranteed by the arrangement of first elements. The second elements can therefore consist of hard material that can be structured from particularly rigid and pressure-stable stopping surfaces, and thereby achieve an expressly stabile hyper-extension resistance. The colliding stopping surfaces therefore cause an effective locking action against further backwards movement. In this way, a hyperextension of the hand, e.g., the fingers becomes effectively hindered, even with a considerable applied force.

Simultaneously, the bendability for the arrangement of first elements of the reinforcement in a glove makes possible the almost unhindered natural movement of the hand, e.g., the fingers. The reinforcement unproblematically tracks the curling of the fingers during the formation of a fist from the hand.

In accordance with a first embodiment of the invention, it is contemplated that at least two stopping surfaces of adjacent first elements at least partly touch in the extended state and therewith counteract further backwards movement.

As to the functionality, the advantage additionally lies by the use of a glove, that two different groups of stopping surfaces collide and thereby resist the hyperextension and the further movement of the fingers by excessive force: On the one hand the stopping surfaces within the arrangement of first elements, i.e. the stopping surfaces of adjacent first elements, on the other hand the stopping surfaces of the second elements. The many colliding stopping surfaces produce a particularly effective locking action against further backwards movement, and thereby hinder a hyperextension of the hand, e.g., the fingers even with considerable force.

Alternative or additionally to these first embodiments, it can be contemplated that a) between at least two neighboring first elements, in particular between all neighboring first elements, at least a first stopping surface and at least a second stopping surface are configured, and b) between at least two second elements, in particular between each neighboring second elements, at least a third stopping surface and at least a fourth stopping surface is configured, c) wherein in the curved state between the first stopping surface and the second stopping surface, neighboring first elements and between the third stopping surface and the fourth stopping surface, neighboring elements are configured, and d) wherein in the extended state, neighboring first elements of the first stopping surface and the second stopping surface, as well as neighboring second elements of the third stopping surface and the fourth stopping surface touch at least in part and thereby counteract further backwards movement.

The advantages of this embodiment correspond to the already aforementioned advantages.

At an alternative second embodiment of the reinforcement in accordance with the invention are configured at least between a first element and a second element at least two stopping surfaces between which in the curved state, an interspace is configured and which in the extended state at least these partly touch each other, and thereby counteract further backwards movement.

The second embodiment also has the advantage that similar to the first embodiment, two different groups of stopping surfaces counteract the hyper extending of the fingers from excessive applied force. On the one hand, it has to do with the stopping surfaces of the second elements which in the extended state are in turn pushed against each other. On the other hand additionally, it has to do with a stopping surface group with which one stopping surface of a first element each acts in combination with a stopping surface of a second element. Thereby, the hardness of the second elements is exposed to this second stopping surface group also for the locking action with all advantages arising from it according to the prominent explanations. This second embodiment is therefore a particularly advantageous and correspondingly preferential embodiment of the reinforcement in accordance with the invention.

A useful further configuration of the second embodiment includes that the second element is at least partly disposed between adjacent first elements in the interspace. Thereby, the stopping surface configuration is achieved between the first and the second elements in accordance with the second embodiment.

Alternatively or additionally to the previously named second embodiment, a reinforcement can further be contemplated with which, a) between at least a first element and a second element at least a first stopping surface and at least a second stopping surface are configured, and b) between at least two neighboring second elements, particularly between at least two neighboring second elements, at least a third stopping surface and at least a fourth stopping surface are configured, c) thereby in the curved state between the first stopping surface and the second stopping surface, and between the third stopping surface and the fourth stopping surface, an interspace is configured, and d) thereby in the extended state, the first stopping surface and the second stopping surface, as well as the third stopping surface and the fourth stopping surface, at least partially touch and thereby counteract a further backward motion.

The advantages of these variants correspond to the already aforementioned advantages.

In accordance with a further embodiment of these variants, is that with the first element, at the first stopping surface and at the second stopping surface of the corresponding second element to which one of the first elements is fastened in particular to a neighboring first element. Additionally and furthermore, one of the first stopping surface and/or second stopping surface of a partially curved away second element, can at least partially touch at a face of the first element, and in fact long-term, i.e., in both extended and curved configuration state of the arrangement of first elements.

In accordance with a further embodiment of all aforementioned variants, it is contemplated that a first stopping surface essentially at least lies in a common plane with at least a third stopping surface and/or a second stopping surface essentially at least lies in a common plane with at least a fourth stopping surface. This preferably applies to all first and/or second stopping surfaces.

A preferential and advantageous further configuration of the reinforcement is contemplated as an alternative variant and, indeed, with regard to all aforementioned variants, that the third and fourth stopping surfaces are disposed opposite the first and second stopping surfaces. A preferential configuration is contemplated that the third and fourth stopping surfaces and/or the projections of the third and fourth stopping surfaces are respectively between adjacent first and second stopping surfaces on the arrangement of first elements. This means particularly that the third and fourth stopping surfaces do not represent a simple repeat of the first and second stopping surfaces. The third and fourth stopping surfaces particularly do not border directly on the first and second stopping surfaces. Rather, the third and fourth stopping surfaces define a different group of stopping surfaces, compared to the first and second stopping surfaces. Insofar that the stopping surfaces are evenly configured and thus define one stopping plane each, this means that the third and fourth stopping surfaces do not lie in the stopping planes defined by the first and second stopping surfaces.

In accordance with a preferential embodiment, two of the stopping surfaces, in particular the first and second stopping surfaces and/or the third and fourth stopping surfaces are at least essentially vertically oriented to one of the defined bending planes for forwards and backwards movement. The bending plane is moved relative to the defined reinforcement plane, within which an arbitrary point of the arrangement of first elements at forwards and backwards movement of the arrangement of first elements. All other points of the arrangement of first elements move in the same plane or in a plane parallel thereto.

A useful further configuration of the reinforcement in accordance with the invention includes an integral arrangement of first elements, and particularly is produced or producible in an injection molding procedure. It also can be contemplated that the interspaces are formed by slice and/or removal and/or slits, particularly penetrating slits, between adjacent first elements in the arrangement of first elements. Both makes a simple and economical production of the reinforcement possible.

In accordance with an embodiment, all first elements can essentially show the same outer shape and/or essentially the same measurements. It is also possible for example, that the outer shape and/or the dimensions of all the first elements are not all identical.

An execution of the reinforcement in accordance with the invention can be configured also so much that at least several of the second elements be connected to each other. Alternatively or additionally you also can provide, however, that at least several of the second elements are not connected to each other.

A further configuration of the reinforcement is contemplated that all second elements essentially show the same outer form and/or essentially the same measurements. However, an alternative also is contemplated that the outer form and/or the measurements of the second elements are not all identical. The first variant is simple to produce and thus economical. The second variant makes possible the individual adaptation to form requirements at use of the reinforcement at a glove for example to special glove areas like finger-or hand-movement in which the reinforcement is configured. By a corresponding individual configuration of the second elements for example the wearing comfort of the gloves and their functionality is improved.

In accordance with an advantageous and preferential configuration of the reinforcement, the second elements are essentially pressure resistant and/or essentially not deformable and/or configured essentially hard and/or the arrangement of first elements is essentially bendably configured. Thereby, particularly stable stopping surfaces are configured at the second elements. Against this background, this is particularly important that the arrangement of first elements is flexible and accordingly at least with integral configuration, no comparable configuration of pressure-resistant stopping surfaces is possible.

It is also advantageous if the first elements at least essentially consist of synthetic material, particularly of thermoplastic synthetic material, preferably of polypropylene and/or the second essentially consist of synthetic material particularly made of thermoplastic synthetic material, preferably from polycarbonate for example from Makrolon®. Synthetic material exhibits a low density in comparison with metals, for example, reinforcement formed therefrom therefore increases the total weight of a glove only insignificantly. In addition, it makes a simple and economical production of the reinforcement possible.

In accordance with an advantageous further configuration of the reinforcement in accordance with the invention is contemplated that the second elements essentially consist of a harder and/or more pressure resistant material than the first elements, particularly the modulus of elasticity of the material of the second elements is greater than the modulus of elasticity of the material of the first elements and/or the hardness of the material of the second elements is greater than the hardness of the material of the first elements. This configuration is possible because indeed, since although the arrangement of first elements must be flexible to not hinder the natural movement of the fingers in a glove at use, for example, the second elements can possibly be configured, however, arbitrarily tightly and thus also rigid or pressure resistant. Thereby, between the second elements, essentially more stable stopping surfaces can be configured than in the first elements, which as an example provides a considerable increase of the supporting effect by the reinforcement in a glove in the case of a hyper extending of the fingers.

A preferential embodiment of the reinforcement in accordance with the invention is contemplated that an underside of the arrangement of first elements is curved concavely in the curved state and/or the second elements are ordered at a top side of the arrangement of first elements that are facing the underside. This embodiment is suitable for the use particularly in a glove. The arrangement is carried out that the underside of the arrangement of first elements is available with a glove interior, and the second elements are available at the outside of the glove.

A further embodiment of the invention is contemplated, that the second elements with at least one, and in particular exactly one, shank fasteners are fastened or fastenable at the arrangement of first elements. It can be contemplated that shank fasteners have at a minimum, and in particular with the second element, fasteners including a stopping shank and a stopping hub, and a space, particularly a corridor with at least a stopping edge that particularly include the arrangement of first elements in which for the attachment of the second elements the fasteners attach through the corridor, and the stopping hub fastens to the stopping edge. Additionally it can be contemplated that the stopping fastener contains two or three or four symmetrically formed fasteners and/or the space, for example the corridor, essentially exhibits a round, and particularly a circular, cross section.

The advantage of stopping connections lies particularly therein, that they can be manufactured simply and economically. For example, the fasteners can be configured at the second elements as integral units. The fasteners can be inserted into corresponding spaces of the first element, their stopping hubs attaches behind to the edge of the respective spaces. In this way, a stopping fastener of the second element is established at the arrangement of first elements. Such fastenings are stable according to the given requirements.

A further configuration of the reinforcement according to the invention is contemplated for the prevention of a rotation of the second elements relative to the arrangement of first elements, that the second elements are inserted or insertable by positive locking in to on or more spaces of the arrangement of the first elements. Such a configuration prevents unintentional twisting the second elements relative to the arrangement of first elements, which is important particularly at attachment about a connection.

In accordance with a preferential configuration of the reinforcement, the arrangement of first elements is a longish shape. Thereby, it can be contemplated that in extended and curved states, the movement is oriented in a defined bending plane, that the lengthwise dimension of the arrangement of first elements lies essentially vertical in a plane in the extended and in the curved state through forwards and backwards bending planes. This bending plane can alternatively be provided that the lengthwise dimension of the arrangement of the first elements in the extended and in the curved state, lies in a plane that is essentially parallel to one through this forwards and backwards movement. The bending plane was already explained prominently more precisely. The first variant is suitable for use in a glove in the area movement of the hand and the wrist, for example. The second variant is suitable for use particularly in gloves in the area of finger movement.

In accordance with a further configuration of the second variant, the first elements and/or the second elements are arranged lengthwise to the arrangement of first elements as they are lined up. It can alternatively or additionally be contemplated that the third and fourth stopping surfaces of the second elements are arranged along the lengthwise dimension of the arrangement of first elements moved are ordered to the first and second stopping surfaces of the arrangement of first elements.

Furthermore it can be contemplated that the second elements are also configured longishly and their lengthwise dimension is essentially configured parallel to the arrangement of first elements to the plane of the lengthwise dimension.

An embodiment variant of the reinforcement in accordance with the invention provides that the arrangement of first elements shows areas of stronger and weaker bendability in which areas of stronger bendability are configured particularly in the transition zone between the first elements. In particular, the regions of stronger bendability can at least be partly configured more thinly than the areas of weaker bendability.

A further advantageous embodiment of the reinforcement is contemplated, that the arrangement of first elements reposes easily in a state curved when unloaded, i.e. without the effect of external forces. During use of the reinforcement that is configured in such a way as in a glove, the natural hand position, and in referring to the finger position, makes the wearing comfort of the glove possible.

The invention in accordance with claim 14 contemplates the use of a reinforcement configured in accordance with the above explanations in a glove, particularly a goalkeeper glove. The glove essentially encloses a glove interior and is surrounded by an glove exterior. In this manner, all advantages described above, are able to make useful the reinforcement for the glove.

An advantageous and preferential embodiment of this glove that relates to one or more finger movement sections, wherein at least in a given finger movement section, and particularly in all finger movement sections, the reinforcement is disposed.

Particularly is contemplated that the reinforcement essentially extends over the complete finger movement section. The finger movement section of a glove extends itself from region around a fingertip up to the region around a first finger joint proximal the hand. By this configuration, an optimal protection of all finger joints and therefore all fingers is therefore achieved.

A preferential and useful embodiment of the glove in accordance with the invention is contemplated that the reinforcements are configured in a way that an underside of the arrangement of first elements is curved concavely in the curved state and the second elements are ordered at a top side of the arrangement of first elements facing the underside, and that the reinforcements are arranged in such a way in the glove that the underside of the arrangement of first elements is curved towards the glove interior. The second elements are therefore curved towards the glove exterior.

Usefully, the reinforcement with respect to the reinforcement in the glove as reinforcement(s) is configured and particularly of a flexible material, particularly cloth or leather, to cover the glove interior to cover the glove exterior. By way of example, the reinforcements are inserted between an outer material and a lining of the finger areas, particularly the finger movement areas of the gloves. In particular they can be sewn into position.

With the invention, therefore a glove was manufactured, particularly a goalkeeper glove which effectively prevents an injury of hand or fingers by hyper extension by reinforcements arranged suitably and which is economically producible due to the simple manufacturability of the reinforcement.

The invention is hereinafter explained more precisely also with regard to broader features and advantages with the description of example embodiments and under reference to the enclosed drawings. Depicted are FIG. 1 a schematic side view of an execution example of a first execution form of reinforcement in accordance with the invention in a curved condition, FIG. 2 a schematic side view of the execution example in accordance with FIG. 1 in an extended condition, FIG. 3 a schematic side view of an execution example of a second execution form of reinforcement in accordance with the invention in a curved condition, FIG. 4 a schematic top view on the execution example in accordance with FIG. 3, also in a curved condition, FIG. 5 a schematic top view on the back of the hand page of an execution example of a glove with reinforcement in accordance with the invention, FIG. 6 a schematic side view in an execution example of a stopping connection to the attachment of second elements at an order of first elements in an execution example of a reinforcement, and FIG. 7 a schematic bottom view of the stopping connection in accordance with FIG. 6.

Parts and components corresponding to each other in FIG. 1 to FIG. 7 are marked by the same reference numerals.

Figure 2:
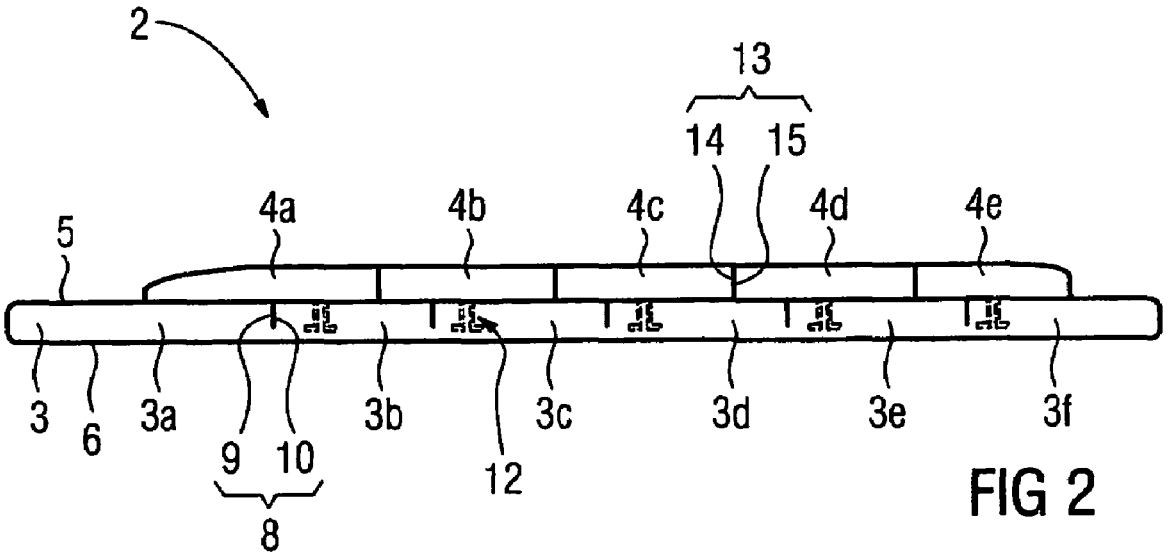

FIG. 1 and FIG. 2 show a side view of an execution example to the invention; FIG. 1 in a curved state and FIG. 2 in an extended state, respectively schematically in accordance with a first embodiment of reinforcement 2. Depicted in FIG. 1 and FIG. 2 are an arrangement 3 of first elements 3*a*, 3*b*, 3*c*, 3*d*, 3*e*, 3*f*, and several second elements 4*a*, 4*b*, 4*c*, 4*d*, 4*e*.

The configuration 3 of first elements of 3*a* . . . , 3*f* is configured longishly; its lengthwise dimension goes in the illustrated drawing plane. The individual first elements 3*a* . . . , 3*f* are lined up along the lengthwise dimension of the arrangement. Furthermore, the arrangement 3 of first elements 3*a* to 3*f* illustrates a top side 5 and an underside 6 facing the top side 5. In FIG. 2, an arrangement 3 of first elements 3*a* to 3*f* is found in an curved extended state along the lengthwise dimension, and indeed in a manner, that the underside 6 of the arrangement 3 of first elements 3*a* to 3*f* that is concave and the top side 5 of the arrangement 3 of first elements 3*a* to 3*f* is convexly curved.

Several cuts 7 (slits) are formed in the top side 5 of the arrangement 3 of first elements 3*a*to 3*f*. These cuts 7 proceed crossways to the lengthwise dimension of the arrangement 3 of first elements 3*a* to 3*f*, drawing plane and vertical represented to this one, i.e. vertical to this one by the extended one and the state curved of the arrangement 3 of first elements 3*a* to 3*f* and the movement between these states defined bending plane of the arrangement 3 of first elements 3*a* to 3*f*.

The slices 7 in the arrangement 3 of the first elements 3*a* to 3*f* separate single first elements 3*a* to 3*f* piecemeal from each other. The slices are not configured throughout, though, so that each neighboring first elements 3*a* to 3*f* are obliged to be directly connected to each other, and thereby the represented arrangement 3 of first elements 3*a* to 3*f* are singly producible and advantageously from synthetic material, for example polypropylene in the injection molding procedure.

The slices 7 in the arrangement of first elements 3 form a stopping surface 8 with each respective adjacent-positioned surface, including a first stopping surface 9 and a second stopping surface 10. The first stopping surface 9 as well as the second stopping surface 10 is depicted in with FIG. 1 and FIG. 2 first embodiments of a reinforcement 2 to the arrangement of first elements 3. An interspace 11 is depicted in the FIG. 1 and a curved state of the arrangement 3 of first elements 3*a* to 3*f* is between first stopping surface 9 and second stopping surface 10. With strong bending of the arrangement 3 of first elements 3*a* to 3*f*, meaning, with a forward movement, the interspace 11 becomes larger, and by a relaxing bend, i.e. backwards movement and transportation of the arrangement 3 of first elements 3*a* to 3*f*, the interspace 11 becomes smaller and ultimately disappears. In the extended state for the arrangement 3 of the first elements 3*a* to 3*f*, as illustrate in FIG. 2, the first stopping surface 9 and the second stopping surface 10 of the stopping surface pairs of 8 of the arrangement 3 of first elements 3*a* to 3*f* are pushed together. Through the pushing together of the stopping surfaces 9, 10, the stopping surface pairs 8 achieve a further backwards movement of the arrangement 3 of first elements of 3*a* to 3*f*, i.e. an over-extension (bend in the direction which is not provided and set, i.e. concave curvature of the top side 5 of the first element 3).

FIG. 1 and FIG. 2 further illustrate that the second elements 4*a* to 4*e* are fastened at the upper surface of the first elements 3*a* to 3*f*. The fastening is carried out via fasteners 12 represented schematically (hatched), that are at the second elements of 4*a* to 4*e*. These fasteners 12 are extended into spaces (that are not are illustrated) of the first elements 3*a* to 3*f*. An execution example of this stopping connection is described below with FIG. 6 and FIG. 7.

The second elements 4*a* to 4*e* are configured longishly, their lengthwise dimension goes in the illustrated drawing plane. Therewith, the second elements 4*a* to 4*e* are arranged in their lengthways direction of essentially parallel to the lengthwise dimension of the arrangement 3 of first elements 3*a* to 3*f*. Thereby it is to be understood, that at a vertical projection of the outlines of the second elements 4*a* to 4*e* to the upper surface 5 of the arrangement 3 of first elements 3*a* to 3*f*, the lengthwise dimension of each of the second elements 4*a* to 4*e* corresponds to the arrangement 3 of first elements 3*a* to 3*f*.

The second elements of 4*a* to 4*e* are further strung in their lengthways direction to each other. Each second element 4*a* to 4*e* exhibits as a minimum one side lined up crossways to its lengthways direction, which is curved toward every second element 4*a* to 4*e* that is also curved crossways toward the side of adjacent second elements 4*a* to 4*e*. These surfaces of the second elements 4*a* to 4*e*, each constitute a stopping surface pair 13, including a third stopping surface 14 and a fourth stopping surface 15. Both the stopping surface 14 and the stopping surface 15 are configured on the second elements 4*a* to 4*e*. In the illustrated, curved state of the arrangement of first elements 3 represented in FIG. 1, an interspace 16 is illustrated between third stopping surfaces 14 and fourth stopping surfaces 15, and therewith between the respective adjacent second elements 4*a* to 4*e*. During strong bending, i.e., a forwards bending of the arrangement 3 of first elements 3*a* to 3*f*, the interspace 16 becomes larger, and during a relieving bending, i.e. a backwards movement and transportation of the arrangement 3 of first elements 3 in the extended state, the interspace 16 becomes smaller between the third stopping surface 14 and the fourth stopping surface 15, and thereby also between the respective adjacent second elements 4*a* to 4*e*. In the extended state as illustrated in FIG. 2, the arrangement 3 of first elements 3*a* to 3*f* collide at the third stopping surface 14 and the fourth stopping surface 15 of the stopping surface pair 13. Through the mutual collision of the stopping surfaces 14 and 15, the stopping surface pairs 13 of the second elements 4*a* to 4*e* as well as the stopping surface pairs 8 in the arrangement 3 the of the first element 3*a* to 3*f* result in resistance to a further backwards movement and hyperextension of the arrangement 3 of first elements 3*a* to 3*f*.

It is seen in FIG. 1 and FIG. 2 that the stopping surface pairs of 8 in the arrangement 3 of first elements 3*a* to 3*f* along the lengthwise dimension of the arrangement 3 of first elements 3*a* to 3*f*, in opposition to the stopping surface pairs 13 of the second elements 4*a* to 4*e* are moved. Therewith the stopping surface pairs 13 of the second elements 4*a* to 4*a* display not merely an extension of the first stopping surface pairs 8 in the first element 3, rather, they form a unique, independent group of stopping surface pairs.

Altogether, two different groups of stopping surface pair of 8, 13 therefore counteract a hyperextension. It is particularly effective to develop a selected locking action, when the second elements 4*a* to 4*e* are made from a rigid, hard, and deformation resistant material, preferably of synthetic material, for example polycarbonate (e.g. Makrolon®.

With alternative execution examples, however, it is contemplated that each of the stopping surface pairs 8 can also lie essentially in a single plane with one of the stopping surface pairs 13 (not represented here).

An alternative variant of the first embodiment is contemplated, that in the extended state of the arrangement 3 of the first elements merely the third stopping surface 14 and the fourth stopping surface 15 collide, but the first stopping surface 9 and second stopping surface 10 do not collide, i.e., the first stopping surface 9 and second stopping surface 10 are set mutually spaced apart. Thereby only the stopping surface pair of 13 forms an effective stopping surface pair. Generally it is sufficient, that this stopping surface pair 13 is formed of the harder material of the second elements of 4*a* to 4*e*, and is particularly effectively therefore to resist further backwards movement, and it jams effectively. A side effect of the stopping pairs 8, which are formed from the bendable and therewith softer material of the arrangement 3 of the first elements 3*a* to 3*f*, can not make any essential additional contribution under circumstances and therefore can be also dropped completely.

In FIG. 1 and FIG. 2 it is still apparent that the second elements of 4*a* to 4*e* need not all carry the same external shape. In the represented reinforcement 2, the second elements 4*b*, 4*c*, 4*d* essentially correspond, whereas the two elements 4*a*, 4*e* show a divergent configuration, particularly other lengthways measurements and a rounded edge. Suitably, the configuration of the second elements of 4*a* to 4*e* adapt to the requirements of the respective glove for which they are designated and to their contemplated position in the respective glove.

Figure 3:
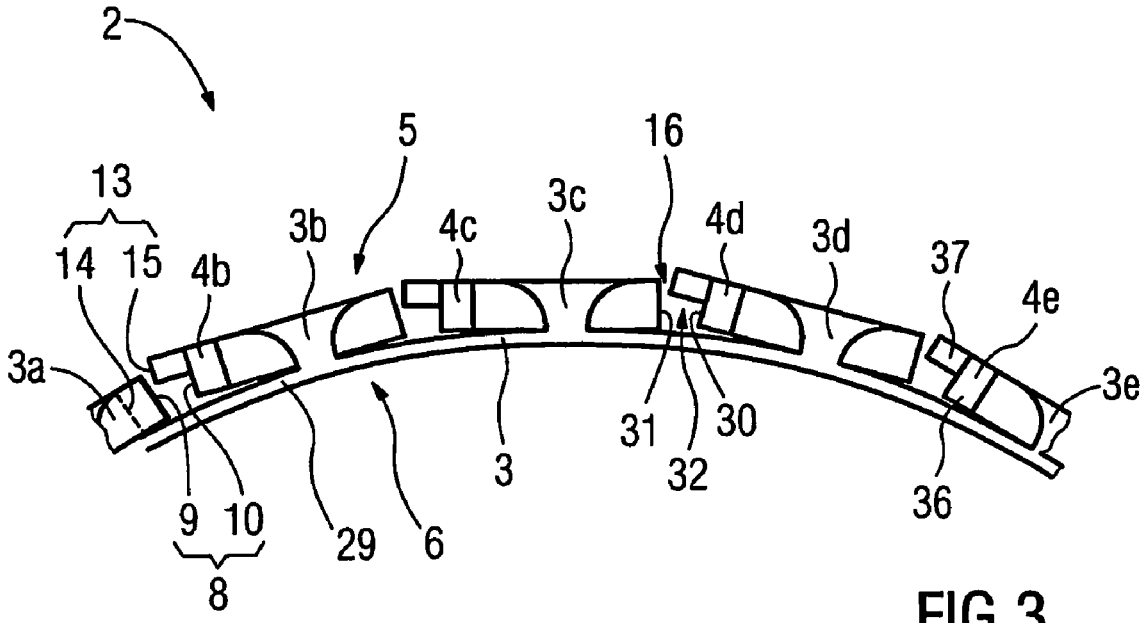
Figure 4:
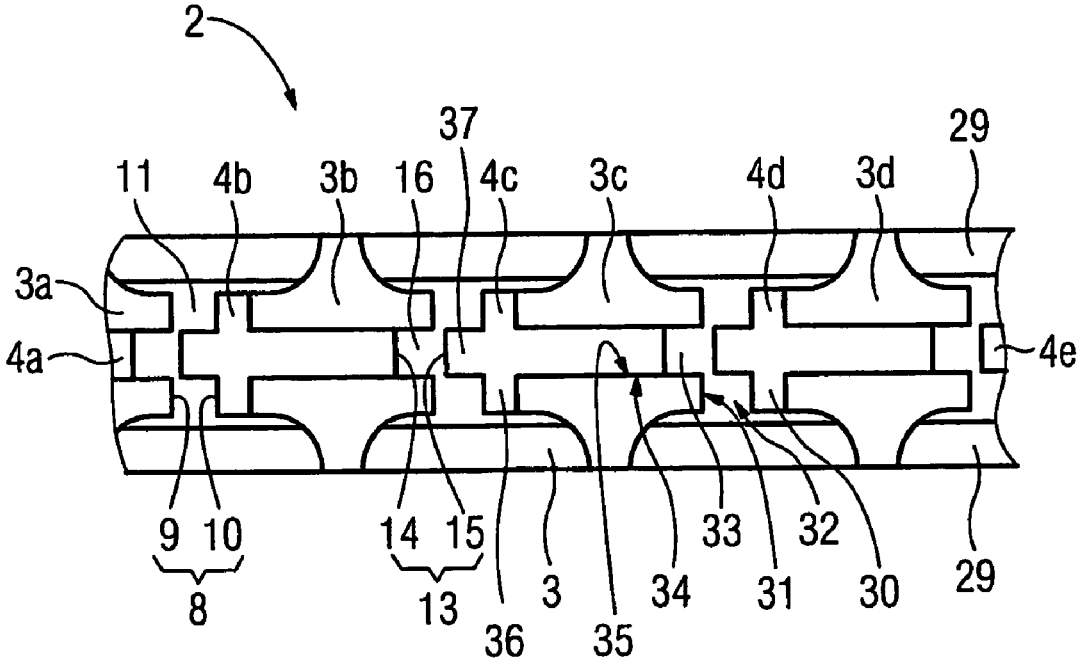

FIG. 3 also shows a schematic side view and FIG. 4 likewise shows a schematic top view of execution example of a second embodiment of a reinforcement 2 in a curved state in accordance with the invention. Both figures show respectively only one part of the reinforcement 2. Notable in FIG. 3 and again in FIG. 4 is an arrangement 3 of first elements 3*a*, 3*b*, 3*c*, 3*d*, 3*e* and several second elements 4*a*, 4*b*, 4*c*, 4*d*, 4*e*. Boundar strips 29 belong to the arrangement 3 of first elements 3*a* to 3*e* over which the individual first elements are mutually bound. Altogether, the arrangement 3 of first elements 3*a* to 3*e* that are bordered by the boundary strips 29 can be integrally produced or producible, preferably from synthetic material, for example polypropylene, in the injection molding procedure.

The arrangement 3 of first elements 3*a* to 3*e* is configured longishly, its lengthwise dimension runs in the illustrated drawing plane. The individual first elements 3*a* to 3*e* are lined up along the lengthwise dimension of the arrangement 3. Furthermore the arrangement 3 of first elements 3*a* to 3*e* a top side 5 and an underside 6 opposite the top side 5. The observer looks at the top side 5 of the arrangement 3 of first elements in FIG. 4. In FIG. 3 and FIG. 4, the arrangement 3 of first elements 3*a* to 3*e* in a curved state, meaning that arrangement 3 is curved along its lengthwise dimension and, indeed, in such as way that the underside 6 of the arrangement 3 of first elements 3*a* to, 3*e* is concavely curved and the top side 5 of the arrangement 3 of first elements 3*a* to 3*e* is convexly curved convexly.

The individual first elements 3*a* to 3*e* depict side surfaces, that run crosswise to the lengthwise dimension, i.e., vertical to the depiction in the drawing plane and vertical to the extended and curved state of the arrangement 3 of first elements 3*a* to, 3*e* and the movement between these states of defined bending planes of the arrangement 3 of first elements 3*a* to, 3*e*. Thereby each of a first side surface 30 of first elements 3*a* to 3*e* is curved towards a second side surface 31 of neighboring elements 3*a* to 3*e*. Between each of the first side surfaces 30 and second side surfaces 31 as they are curved towards each other is an interspace 32, and both in the represented curved state of the arrangement 3 of first elements to be more precise and in the not represented extended state.

FIG. 3 and FIG. 4 further indicate that the second elements 4*a* to 4*e* are fastened at the top side 5 of the first elements. Herewith the second elements 4*a* to 4*e* are set into the spaces 33 of the first elements 3*a* to 3*e*, and indeed in that way, that an outer boundary of the second elements 4*a* to 4*e* do not stick out over a boundary of the space 33 in which each respective second element 4*a* to 4*e* is inserted. The fastening is achieved for example of fasteners (not illustrated) that are formed on the second elements 4*a* to 4*e*. These fasteners lodged in the spaces (not pictured) of the first elements 3*a* to 3*e*. An execution example of this stopping connection is set forth below with FIG. 6 and FIG. 7 but any alternative explanations are also contemplated conceivable.

The second elements of 4*a* to 4*e* are configured longishly, their lengthwise dimension runs in the illustrated drawing plane. Therewith, the second elements 4*a* to 4*e* are arranged in their lengthways direction of essentially parallel to the lengthwise dimension of the arrangement 3 first elements 3*a* to 3*e*. Thereby it is understood that with a vertical projection of the contours of the second elements 4*a*, . . . , 42 corresponds with the top side 5 of the arrangement 3 of first elements 3*a* to 3*e*. The second elements 4*a* to 4*e* are lined up in their lengthwise direction.

In a difference to the second elements 4*a* to 4*e* of the first embodiment according to FIG. 1 and FIG. 2, the second elements which in FIG. 3 and FIG. 4 illustrate the second embodiment of a widening 36. This widening 36 shows opposing faces that are essentially vertically arranged to the lengthwise dimension of the second elements of 4*a* to 4*e*. The widening 36 is configured so that in the cross-sectional measurement corresponds at least as far as with the measurements of the first side surfaces 30 and/or the second side surface 31 of the first elements of 3*a* to 3*e*. The second elements 4*a* to 4*e* arranged in a way on the first elements 3*a* to 3*e*, that one of the second elements 4*a* to 4*e* that is vertically oriented to the lengthwise dimension at least partly covers the widening 36. The widening 36 is configured therewith at the interspace 32 between each first surface 30 and second surface 31 that are curved towards each other.

Those of the side surfaces of the widening 36 that lay against the first elements 3*a* to 3*e*, opposite lying side surfaces of the widening 36 is the second side surface 31 turned to the neighboring first element. The measurements of the interspace 32 and of the widening 36 are coordinated in so much with each other that the second side surface 31 of the first elements 3*a* to 3*e* and the face curved towards the widening, form a stopping surface pair of 8, containing a first stopping surface 9, formed of the second face 31 of the first elements 3*a* to 3*e* and face curved towards stopping surface 10, formed of that one of the first stopping surface 9 a second the widening 36 of the second element 4*a* to 4*e*. The stopping surface pair 8 therefore is not formed as in the case of the first embodiment of the reinforcement 2 in accordance with FIG. 1 and FIG. 2 alone from the areas of the first elements 3*a* to 3*e*, rather, the stopping surface pair encompasses only a surface of a first element 3*a* to 3*e*, the second surface is formed of a second element, 4*a* to 4*e*. In the curved state of the arrangement 3 of first elements 3*a* to 3*e* an interspace 11 is found between the first stopping surface 9 and the second stopping surface, which gets smaller with backwards movement of the reinforcement 2.

Furthermore every second element 4*a* to 4*e* in one of its lengthways ends, shows on at least a side lined up crossways to its lengthways direction, an also crossways laying side at a lengthways end that is open to a neighboring second element 4*a* to 4*e*. The sides of the second elements 4*a* to 4*e* each make a further stopping surface pair 14 and a fourth stopping surface 15. Both the stopping surface 14 and the stopping surface 15 are therewith configured at the second elements 4*a* to 4*e*. Between the third stopping surface 14 and the fourth stopping surface 15, an interspace 16 is located in a curved relation to the arrangement 3 of first elements 3*a* to 3*e*, which interspace 16 becomes smaller with the backwards movement of the reinforcement 2.

The first stopping surface 9 and the third stopping surface 14 as well as the second stopping surface 10 and the fourth stopping surface 15 can respectively lie in a plane. Preferably and as depicted in FIG. 3 and FIG. 4, however, the mentioned surfaces do not each lie in a single plane. The stopping surface pairs of 8 and 13 are rather given to the arrangement 3 of first elements 3*a* to 3*e* to each other along the lengthwise dimension. This is achieved thereby, that the widening 36 is not configured on a lengthways edge of the second elements 4*a* to 43, rather, in a middle region. Thereby, the second elements 4*a* to 4*e* each show a prominence 37 at their lengthways ends over the widening 36, at which ends in the lengthwise direction is configured the fourth stopping surface 15 opposite the second stopping surface 10. This does not simply thereby form stopping surface pairs of 13 that is a prolongation of the stopping surface pair 8, but an independent group of stopping surface pairs.

The measurements of the second elements 4*a* to 4*e* are chosen so that the spaces 33 in the first elements 3*a* to 3*a* are not completely filled out by them respectively lengthwise. With the changing of the arrangement 3 of first elements 3*a* to 3*e* from the curved state into the extended state, the prominences 37 of the second elements 4*a* to 4*e* penetrated into these empty regions of the Spaces 33, and indeed to a degree until the third stopping surface 14 and the fourth stopping surface 15 at least partially stop against each other (not illustrated) and thereby resist a further backwards movement, i.e., a hyperextension of the reinforcement 2, and therefore stop them. At the same time also push the first stopping surface 9 and the second stopping surface 10 to each other (not represented) and thus also stop further backwards movement.

Also in the second embodiment of a reinforcement 2 in accordance with FIG. 3 and FIG. 4, two groups of stopping surface pairs of 8, 13 therefore achieve a further backwards movement by reaching of the extended state of the arrangement 3 of first elements 3*a* to 3*e*, and thereby against a hyperextension. The locking action obtained thereby is particularly effective if the second elements 4*a* to 4*e* are made from a pressure-resistant, hard, deformation-resistant material, preferably from artificial material, for example polycarbonate (e.g. Makrolon®). The arrangement 3 of first elements 3*a* to 3*a* must, however, consist of a flexible material, preferably of synthetic material, for example of polycarbonate to ensure of the bendability of the reinforcement. In accordance with the second embodiment all stopping surfaces 10, 14, 15 are formed of the harder material with that except for the first stopping surfaces 9 which the makes the locking action particularly effective.

It is clear that with the second embodiment that single occurrences of the first elements 3*a* to 3*e* and/or single occurrences of the second elements can be configured or formed differently from these respectively other elements, particularly the respective edge elements at the lengthways ends of the reinforcement. For example, different lengths, flattening outs and/or rounding-downs can be contemplated. However, all elements also can be respectively identically configured or formed. Usefully the configuration of the elements becomes adapted to the requirements of the respective glove for which they certainly are contemplated position in the respective glove.

Figure 5:
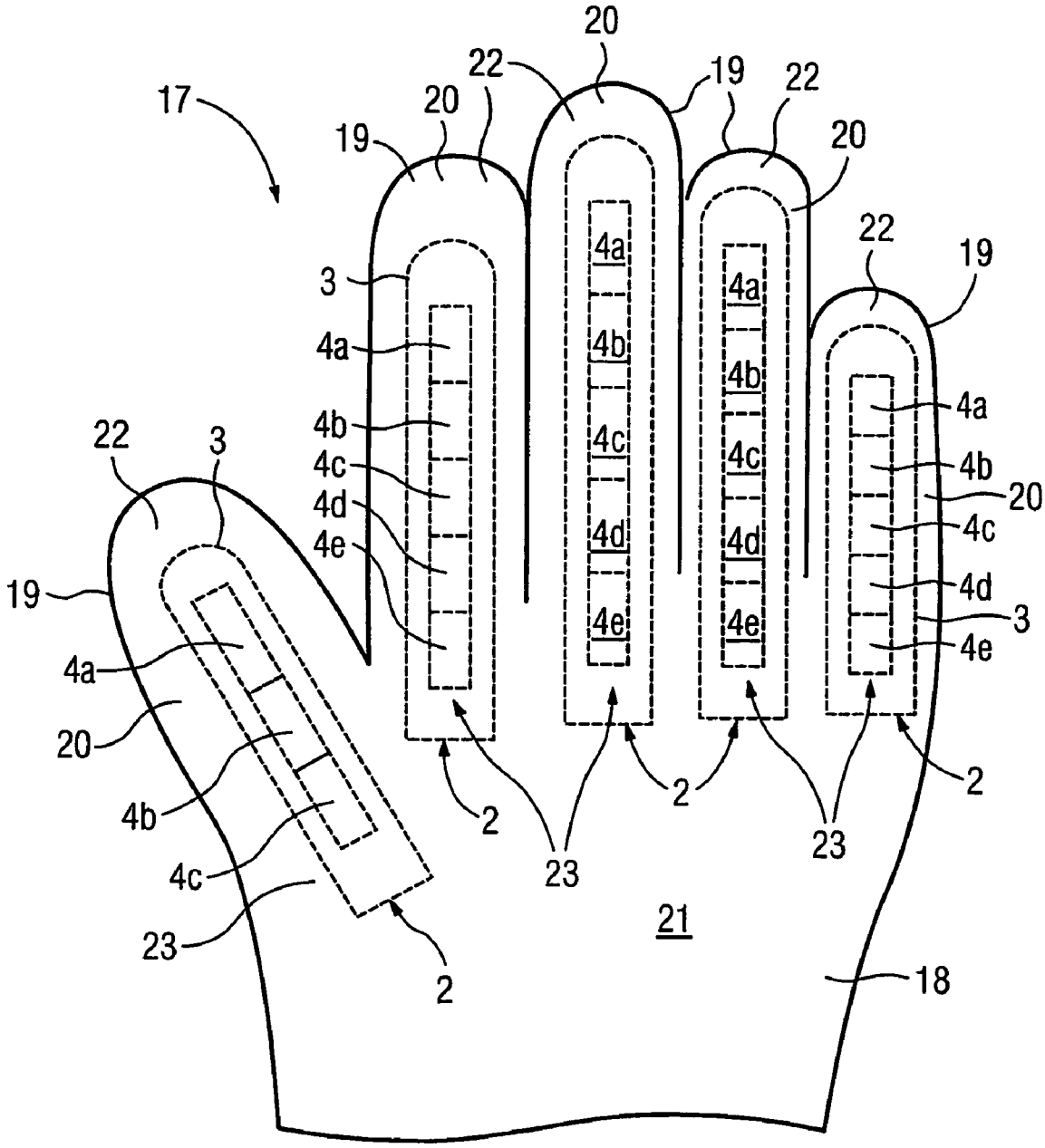

FIG. 5 shows schematically a top view in accordance with the invention on a glove back surface 18 of an execution example of a glove 17. An arrangement is schematically and symbolically represented by reinforcement 2 with dotted lines. These reinforcements 2 can essentially correspond to the reinforcement 2 from FIG. 1 and FIG. 2, for example, however, it can just be reinforcement according to FIG. 3 and FIG. 4 or around further variants.

The glove 17 shows several essentially comparable finger sections 19 which contain one finger movement part each, 20. The finger movement part 20 transition into a back of the hand section 21. Reinforcements 2 as a stiffening enclosure are brought in, particularly sewn-in in each of the finger movement parts 20 between an outer material and a lining layer (in FIG. 3 not represented). The top side 5 of the arrangement of first elements 3 of each of the reinforcement 2 the glove back page 18 and curved therewith towards the observer in FIG. 3. Furthermore in FIG. 3 the arrangement 3 of first elements 3*a* to 3*e* (the individual first elements 3*a* to 3*e* are not illustrated) are recognized as being attached to the second elements 4*a* to 4*e*.

The reinforcement 2 extends respectively around the fingertip up to the back of the hand section 21 from an area of 22. The reinforcement 2 still uncovers an area of 23 around a first finger joint at the hand approach of the finger.

Altogether, each of the employed stiffening elements 2 therefore extends essentially over the complete finger movement of the respective finger of a hand inserted into the glove. Thereby, all finger joints are protected against a hyperextension from a strong force. A hyperextension injury of the hand is therefore effectively resisted.

Figure 6:
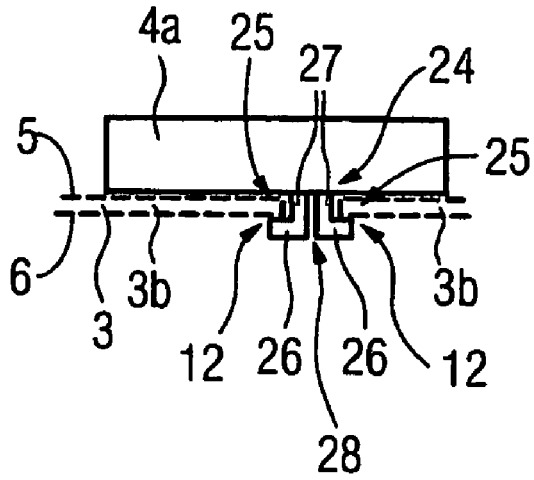
Figure 7:
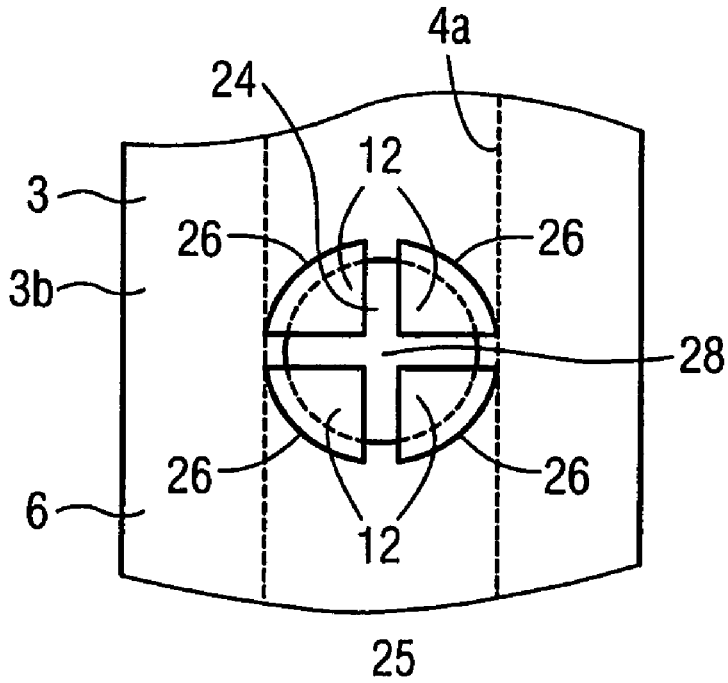

FIG. 6 and FIG. 7 schematically show an execution example of a grid border schematically to the attachment of second elements 4*a* to 4*e*; here seen is element 4*a*, to an arrangement 3 of first elements 3*a* to 3*f*; here element 3*b* in a side view of FIG. 4, and in FIG. 5 in a bottom view. In FIG. 6, a section of the arrangement 3 of first elements is 3*a* to 3*f* is schematically illustrated with a dashed line. This section of the arrangement 3 of first elements 3*a* to 3*f* shows a corridor 24. Further, FIG. 6 is depicted at the top side 5 of the arrangement 3 of first elements 3*a* to 3*f*. Integral fasteners 12 are configured at this element of 4*a*, each of which contains a stopping hub 26, and a flexible stopping shank 27.

The fastening of the second element 4*a* at the arrangement 3 of first elements 3*a* to 3*f* is made by a stopping connection. The stopping connection arises by the fact that the fasteners 12 are effective by the corridor 24. The border of the corridor 24 forms a stopping edge 25 at the underside 6 of the arrangement 3 of first elements 3*a* to 3*f*. This stopping edge 25 is reverse fastened at the achieved stopping connection of the stopping hubs 26 of the shank fasteners 12, i.e. the stopping hubs 26 are so arranged at the underside 6 of the arrangement 3 of first elements 3*a* to 3*f*, that they block reverse-pulling of the fasteners 12 by the corridor 24.

The fasteners 12 are configured essentially symmetrically. An interspace 28 is configured between the fasteners 12, which makes possible the achievement and dissolution of the stopping connection of a bending movement of the rest legs 27.

FIG. 7 shows 3 a top view on a section of the underside 6 of the arrangement 3 of first elements 3*a* to 3*f*. The second element 4*a* is depicted with a dotted line, which second elements 4*a* in this view is depicted at the opposite lying side the farthest hidden second element 4*a*. Four essentially symmetrically shaped fasteners 12 reach through the corridor 24 in the arrangement 3 of first elements 3*a* to 3*f*. The stopping hubs 26 of the fasteners 12 can be recognized respectively. The stopping hubs 26 attach behind to the stopping edge 25 configured by the border of the corridor 24. The stopping edge 25 is therefore covered by the stopping edges 26, it is therefore represented dottedly in these areas.

The interspace 28 configured between the fasteners 12 and is recognizable also in FIG. 7. The interspace 28 makes possible pressing the four fasteners 12 together so that the stopping hubs 26 by the corridor 24 through yokes and this way the rest connection between the second element 4*a* and the arrangement 3 of first elements 3*a* to 3*f*, can be achieved and also uncoupled again. In order to obtain both the fastening, i.e., the backward fastening of the stopping edge 25 by the stopping hubs 26 is the stopping shanks 27 of the fasteners 12 configured reversibly flexibly to make possible achieving and uncoupling for the stopping connection, and, indeed, so much that represented the stopping hubs 26 arranged at the stopping shanks 27 in the unloaded state the stopping edge 25 fastens backward like in FIG. 4 and FIG. 5.

The stopping connection to the fastening of the second elements 4*a* to 4*e* can also alternatively be formed at the arrangement 3 of first elements also by merely a fastener (not represented). The fastener then exhibits preferentially a round cross section, whereby the average through-measurement is smaller than in the area of the stopping hub in the area of the stopping shank. For the production of the stopping connection the stopping hub is pushed by the execution into the arrangement of first elements. Then secured, and therefore the stopping connection over the stopping edge of the fastener counteracts a pulling of the fastener back from the corridor. In this way, the second element 4*a* to 4*e* are permanently located and stably connected with the arrangement 3 of first elements.

REFERENCE NUMERAL LIST

2 Reinforcement
3 arrangement of first elements
3 *a* . . . *f* first elements
4 *a* . . . *e* second elements
5 top side of the arrangement 3 of first elements
6 underside of the arrangement 3 of first elements
7 cut
8 stopping surface pair
9 first stopping surface
10 second stopping surface
11 interspace between first stopping surface 9 and second stopping surface 10
12 fasteners
13 stopping area pair
14 third stopping surface
15 fourth stopping surface
16 gap between third stopping surface 14 and fourth stopping surface 15
17 glove
18 glove back side
19 finger sections
20 finger movement part
21 back of the hand section
22 area around a fingertip
23 area around a first finger joint
24 corridor
25 stopping edge
26 stopping hub
27 stopping shank
28 interspace
29 stopping borders
30 first side surface
31 second side surface
32 interspace
33 spaces
34 border of the space 33
35 outer edge of the second elements 4*a* to 4*e*
36 widening
37 prominence

The invention claimed is:

1. A reinforcement (2) for a glove (17), particularly a goalkeeper glove comprising:

a) an arrangement (3) of several first elements connected to each other (3*a* to 3*f*), b) several second elements (4*a* to 4*f*), that are so connected with the arrangement (3) of first elements (3*a* to 3*f*, that at least two stopping surfaces (14, 15) are configured at least between two neighboring second elements (3*a* to 3*f*), c) wherein the arrangement (3) of first elements (3*a* to 3*f*) is flexible in a forwards movement from an essentially extended state into a curved state, and in a backwards movement from the curved state to the extended state, d) wherein in the curved state one interspace each (11, 32) is configured d1) and between neighboring first elements (3*a* to 3*f*) one interspace each (16) is configured d2), and between the stopping surfaces (14, 15) of neighboring second elements (4*a* to 4*f*)

e) wherein in the extended state, the stopping surfaces (14, 15) of neighboring second elements (4*a* to 4*f*) at least partially touch the other and therewith further counteract backwards movement.

2. The reinforcement according to claim 1, wherein in the extended state at least two stopping surfaces (9, 10) of first neighboring elements (3*a* to 3*e*) at least partially touch the other and further backwards movement is counteracted.

3. The reinforcement according to claim 1, wherein:

a) between at least two neighboring first elements (3*a* to 3*f*), at least a first stopping surface (9) and at least a second stopping surface (10) is provided;

b) at least a third stopping surface (14) and at least a fourth stopping surface (15) are configured between at least two neighboring second elements (4*a* to 4*f*) particularly between all respectively neighboring second elements (4*a* to 4*f*);

c) wherein an interspace (11, 16) is configured in the curved state, between the first stopping surface (9) and the second stopping surface (10) of first neighboring elements (3*a* to 3*f*) and between the third stopping surface (14) and the fourth stopping surface (15) of neighboring second elements (4*a* to 4*f*); and d) wherein in the extended state the first stopping surface (9) and the second stopping surface (10) of neighboring first elements (3*a* to 3*f*) as well as the third stopping surface (14) and the fourth stopping surface (15) of neighboring second elements (4*a* to 4*f*) at least partially touch and thereby counteract further backwards movement.

4. The reinforcement according to claim 1, a) in which between a first element (3*a* to 3*e*) and a second element (4*a* to 4*f*) at least two stopping surfaces (9, 10) are configured, between which in the curved state an interspace (11) is configured, in the extended state and which at least partly touch each other, and further backwards movement is thereby counteracted; or b) in which the second element (4*a* to 4*f*) is arranged at least partially both between neighboring first elements (3*a* to 3*e*) in the interspace (32).

5. The reinforcement according to claim 1 wherein a) at least a first stopping surface (8) and at least a second stopping surface (9) are configured between at least a first element (3*a* to 3*e*) and a second element (4*a* to 4*f*);

b) at least a third stopping surface (14) and at least a fourth stopping surface (15) are configured between at least two neighboring second elements (4*a* to 4*f*);

c) wherein an interspace (11, 16) is configured in the curved state, and between the first stopping surface (9) and the second stopping surface (10) and between the third stopping surface (14) and the fourth stopping surface (15);

d) wherein in the extended state, the first stopping surface (9) and the second stopping surface (10) and the third stopping surface (14), as well as the fourth stopping surface (15) at least partially touch and thereby counteract further backwards movement; or e) wherein, the second element (4*a* to 4*f*)corresponding with the first element (3*a* to 3*e*) about the first stopping surface (9) and second stopping surface (10) is configured at another neighboring first element to the first element (3*a* to 3*e*)(3*a* to 3*e*), or f) wherein one of the turned away first faces of the second element (4*a* to 4*f*) is at least partly on the first stopping surface (9) and/or second stopping surface (10) at a face (30) of the first element.

6. The reinforcement according to claim 1, a) wherein the third and fourth stopping surfaces (13, 14, 15) are displaced opposite the first and second stopping surfaces (8, 9, 10);

b) wherein the third and fourth stopping surfaces (13, 14, 15) and/or projections of the third and fourth stopping surfaces (13, 14, 15) lie therewith on the arrangement (3) of first elements (3*a* to 3*f*) between neighboring first and second stopping surfaces (8, 9, 10) respectively.

7. The reinforcement according to claim 1, a) wherein with the at least two of the stopping surfaces are essentially arranged vertically to a defined bending plane movement, particularly the first and second stopping surfaces (8, 9, 10) and/or the third and fourth stopping surfaces (13, 14, 15) for one of forwards- and backwards movement; or b) wherein the interspaces between neighboring first elements are formed through one of a slice (7) and/or spaces and/or slits, in particular continuous slits, in the arrangement (3) of first elements (3*a* to 3*f*); or c) wherein with all of the first elements (3*a* to 3*f*), the outer shape and/or the measurements are essentially all identical, or wherein with all of the first elements (3*a* to 3*f*), the outer shape and/or the measurements are not essentially all identical; or d) wherein at least several of the second elements (4*a* to 4*f*) are connected to each other; or e) wherein at least several of the second elements (4*a* to 4*f*) are not connected with each other; and/or f) wherein all second elements (4*a* to 4*f*) essentially show the same outer shape and/or essentially show the same measurements or wherein the outer shape and/or the measurements of the second elements (4*a* to 4*f*) are not identical.

8. The reinforcement according to claim 1, a) wherein the arrangement (3) of first elements of (3*a* to 3*f*) is unitarily produced, in an injection molding method or producible; or b) wherein the second elements (4*a* to 4*f*) are essentially resistant to pressure and/or essentially not deformable and/or essentially configured rigid and/or the arrangement of first elements (3*a* to 3*f*) is essentially elastically flexibly configured; or c) wherein the first elements (3*a* to 3*f*) are composed of synthetic material of polypropylene and/or the second elements (4*a* to 4*f*) are essentially of synthetic material, of polycarbonate essentially; or d) wherein the second elements (4*a* to 4*f*) are essentially of a harder material more resistant to pressure passes than the first elements (3*a* to 3*f*), particularly the modulus of elasticity of the material of the second elements (4*a* to 4*f*) is greater than the modulus of elasticity of the material of the first elements (3*a* to 3*f*) and/or the hardness of the material of the second elements (4*a* to 4*f*) is greater than the hardness of the material of the first elements 3*a* to 3*f*); or e) wherein an underside (6) of the arrangement (3) of first elements (3*a* to 3*f*) is curved concavely in the curved state and/or the second elements (4*a* to 4*f*) are ordered at a top side (5) of the arrangement (3) of first elements (3*a* to 3*f*) facing the underside (6).

9. The reinforcement according to claim 1, a) wherein the second elements (4*a* to 4*f*) are fastened with at least one stopping connection to the arrangement (3) of first elements 3*a* to 3*f*);

b) wherein the stopping connection includes particularly in the arrangement (3) of first elements (3*a* to 3*f*), at least one fastener (12) that reverse attaches through the interspace (33) especially through a corridor (24) and that includes a stopping shank (27) and a stopping hub (26) and the corridor (24) with at least a stopping edge (25) stopping fastener (12) particularly by the corridor (24) in which the at least one fastener (12) intrude on the space (24) to fasten the second element (4*a* to 4*f*) in which the stopping connection at least unite, at the second element (4*a* to 4*f*) particularly, and the stopping hub (26) and the stopping edge (25), and/or c) wherein the stopping connection contains two or three or four stopping fasteners (12) configured essentially symmetrically and/or the space exhibits essentially a circular cross section.

10. The reinforcement according to claim 1, wherein for the resisting of a rotation of the second elements (4*a* to 4*f*), the second elements (4*a* to 4*f*) relative to the arrangement (3) of first elements (3*a* to 3*f*) are in a closable configuration into one or several spaces of the first elements (3*a* to 3*f*).

11. The reinforcement according to claim 1, b) wherein the arrangement (3) of first elements (3*a* to 3*f*) forms an elongated shape, wherein particularly the lengthwise dimension of the arrangement (3) of first elements (3*a* to 3*f*) lies in a plane in the extended and in the curved state, which is essentially configured vertically or parallel to one of the forwards- and backwards movement bending plane; or c) wherein the first elements (3*a* to 3*f*) and/or the second elements (4*a* to 4*f*) are configured in the lengthwise direction of the arrangement (3) of first elements (3*a* to 3*f*), or d) the third and fourth stopping surfaces (13, 14, 15) are at this one ordered along the lengthwise dimension of the arrangement (3) of first elements (3*a* to 3*f*) moved to the first and second stopping surfaces (8, 9, 10).

12. The reinforcement according to claim 11, the second elements (4*a* to 4*f*) are elongatedly configured and their lengthwise dimension is couple to the arrangement (3) of first elements (3*a* to 3*f*) essentially parallel to the lengthwise dimension.

13. The reinforcement according to claim 1, a) the arrangement (3) of first elements (3*a* to 3*f*) shows areas of stronger and weaker bendability in which areas of stronger bendability are configured particularly in the transition zone between the first elements (3*a* to 3*f*) and/or in which the areas of stronger bendability are partly configured at least more thinly than the areas of weaker bendability at this one, or b) the arrangement (3) of first elements (3*a* to 3*f*) takes a partially curved state when unloaded.

14. A glove (17), particularly a goalkeeper glove which encloses essentially a glove interior and is surrounded by a glove exterior and which surrounds at least one reinforcement (2) having the structure:

a) an arrangement (3) of several first elements connected to each other (3*a* to 3*f*), b) several second elements (4*a* to 4*f*), that are so connected with the arrangement (3) of first elements (3*a* to 3*f*), that at least two stopping surfaces (14, 15) are configured at least between two neighboring second elements (3*a* to 3*f*), c) wherein the arrangement (3) of first elements (3*a* to 3*f*) is flexible in a forwards movement from an essentially extended state into a curved state, and in a backwards movement from the curved state to the extended state, d) wherein in the curved state one interspace each (11, 32) is configured d1) and between neighboring first elements (3*a* to 3*f*) one interspace each (16) is configured d2), and between the stopping surfaces (14, 15) of neighboring second elements (4*a* to 4*f*)

e) wherein in the extended state, the stopping surfaces (14, 15) of neighboring second elements (4*a* to 4*f*) at least partially touch the other and therewith further counteract backwards movement.

15. The glove (17), particularly the goalkeeper glove, according to claim 14, that includes at least one finger movement section and, wherein the reinforcement (2) extends along the length of the at least one the finger movement section (20).

16. The glove (17), particularly the goalkeeper glove, according to claim 14, (a) wherein the reinforcement (2) is configured wherein the underside (6) of the arrangement (3) of first elements (3*a* to 3*f*) is facing the glove interior; and/or.

17. A reinforcement comprising:

an arrangement of several first elements connected to each other;

several second elements that are so connected with the arrangement of first elements that at least two stopping surfaces are configured at least between two neighboring second elements;

wherein the arrangement of first elements is flexible in a forwards movement from an essentially extended state into a curved state, and in a backwards movement from the curved state to the extended state;

wherein in the curved state one interspace each is configured, and between neighboring first elements one interspace each is configured, and between the stopping surfaces of neighboring second elements;

wherein in the extended state, the stopping surfaces of neighboring second elements at least partially touch the other and therewith further counteract backwards movement.

18. The reinforcement of claim 17, wherein in the extended state at least two stopping surfaces of first neighboring elements at least partially touch the other and further backwards movement is counteracted.

19. The reinforcement of claim 17, wherein:

between at least two neighboring first elements, at least a first stopping surface and at least a second stopping surface is provided;

at least a third stopping surface and at least a fourth stopping surface are configured between at least two neighboring second elements;

wherein an interspace is configured in the curved state, between the first stopping surface and the second stopping surface of first neighboring elements and between the third stopping surface and the fourth stopping surface of neighboring second elements; and wherein in the extended state the first stopping surface and the second stopping surface of neighboring first elements as well as the third stopping surface and the fourth stopping surface of neighboring second elements at least partially touch and thereby counteract further backwards movement.

20. The reinforcement of claim 17, further:

in which between a first element and a second element at least two stopping surfaces are configured, between which in the curved state an interspace is configured, in the extended state the at least two stopping surfaces at least partly touch each other, and further backwards movement is thereby counteracted; or the second element is arranged at least partially both between neighboring first elements in.

* * * * *